United States Patent [19]

Morice et al.

[11] Patent Number: 4,746,362

[45] Date of Patent: May 24, 1988

[54] CRUCIBLE FOR THE THERMAL ANALYSIS OF ALUMINUM ALLOYS

[75] Inventors: Jean Morice; Jean-Jacques Perrier, both of Paris, France

[73] Assignee: Aluminum Pechiney, Paris, France

[21] Appl. No.: 29,989

[22] Filed: Mar. 25, 1987

[30] Foreign Application Priority Data

Mar. 27, 1986 [FR] France ..... 86 04655

[51] Int. Cl.[4] ..... C22B 21/00

[52] U.S. Cl. ..... 75/68 R; 75/95

[58] Field of Search ..... 75/68 R, 95

[56] References Cited

U.S. PATENT DOCUMENTS 2,094,028 9/1937 Stroup ..... 75/95

3,726,666 4/1973 Desre ..... 75/68 R

*Primary Examiner*—Peter D. Rosenberg

*Attorney, Agent, or Firm*—Oblon, Fisher, Spivak, McClelland & Maier

[57] ABSTRACT

A crucible for the thermal analysis of aluminum alloys is disclosed. This crucible is characterized in that the internal surface of at least one of its side walls is at least partially covered with a film of refining agent. The crucible finds application in measuring both the silicon content in and the degree of refining of hypereutectic aluminum-silicon alloys.

5 Claims, No Drawings

CRUCIBLE FOR THE THERMAL ANALYSIS OF ALUMINUM ALLOYS

BACKGROUND OF THE INVENTION

1. Field of the Invention:

The present invention relates to crucibles for the thermal analysis of aluminum alloys, in particular alloys containing a hypereutectic amount of silicon.

2. Discussion of the Background

In cast components of aluminum alloys, one primarily uses alloys containing silicon. Among these alloys containing silicon, a distinction is made between alloys containing more than 12.5% by weight of silicon, which are referred to as hypereutectic, and alloys containing 12.5% or less by weight of silicon.

When hypereutectic alloys are cast, in the course of solidification they firstly give rise to the formation of crystals of silicon, referred to as primary. These crystals of silicon appear at a temperature referred to as the incipient solidification temperature. This formation of crystals of silicon is followed by the formation of eutectic crystals of aluminium-silicon.

The size of the crystals of primary silicon which are formed naturally is relatively large. This is harmful to the production of cast components having suitable properties. It is for that reason that in most cases a refining treatment of the alloy operation is carried out. This operation is carried out in the liquid state, and reduces the size of those crystals as much as possible.

This refining effect can be achieved for example by adding cupro-phosphorus in a variable amount depending on the proportion of silicon and other elements in the alloy being treated. However, that amount of refining agent may vary substantially for the same alloy depending on the treatments to which the metal has been subjected, the fusion procedure, and the presence of certain impurities.

It is for that reason that an excess of refining agent is generally added. Unfortunately, the effect of such a large addition is to dilute the alloy so that if the refining effect is correct, the silicon content of the alloy no longer corresponds to the desired composition.

Moreover, one skilled in this art is very well aware that refining agents have a fleeting effect. That is to say, frequently after just a few minutes between the moment at which the refining agent is introduced into the alloy and the moment of casting, the action of such an agent is reduced to zero.

In casting workshops, a ladle of alloy is used in most cases to successively feed a large number of moulds. With such an operation, if the refining effect is correct at the time of feeding the first moulds, it becomes inadequate and even non-existent for the later moulds.

It has therefore been found essential to be able to provide a way of being aware of the state of refining of the alloy bath at any moment in order to be able to provide for the addition of refining agent as may be necessary and thus avoid casting components not having the desired properties. Likewise, a method for measuring the precise proportion of silicon in the alloy diluted by the refining agent prior to the casting operation is necessary in order to be able to correct, if needed, the proportion of silicon in the alloy by adding a make-up amount of silicon.

Ways of determining the proportion of silicon in alloys are already found in all foundries. These methods involve the use of thermal analysis crucibles. Such crucibles are described in French Pat. No. 2 357 891 (=U.S. Pat. No. 4,105,191). They comprise a cylinder provided with a bottom. They are made either entirely of core sand or with an essentially metal side wall. Disposed within the cylinder is a sheath into which a thermocouple is inserted, the sensitive end of the thermocouple coming into contact with the alloy to be analysed when the alloy is poured in the liquid state into the crucible.

Such crucibles make it possible to follow variations in temperature during solidification of the alloy. In particular they make it possible to detect the incipient solidification temperature Tc, which is manifested by a change in the slope of the temperature-time curve.

In the case of hypereutectic aluminum-silicon alloys, that temperature Tc increases as a function of increasing proportions of silicon. It would thus seem to be an easy matter to determine the amount of silicon contained in the alloy analysed by comparison with previously established curves giving proportions of silicon as a function of the temperature Tc. Unfortunately, it has been found that the size of the primary silicon crystals also has an influence on Tc. Indeed, the larger the crystals, the lower the temperature Tc. So the amount of silicon contained in the alloy cannot be measured in this way.

As has been pointed out above, the degree of refining of industrial alloys may vary to a substantial extent, and likewise the proportion of silicon resulting from dilution by the refining agent may also vary considerably. Therefore, at the time of analysis knowledge of the temperature Tc will not make it possible to determine accurately the proportion of silicon contained in the alloy since that temperature Tc may result both from a combination of a substantial proportion of silicon and large crystals, and a combination of a small proportion of silicon and fine crystals.

There is thus a strongly felt need for a means permitting the suppression of the influence of the size of the crystals on Tc. Such a means would permit to determine with precision the amount of silicon present in the alloy, and at the same time permit to ascertain th degree of refining of the alloy being analysed.

SUMMARY OF THE INVENTION.

Accordingly, it is an object of this invention to provide a means for suppressing the influence of the size of silicon crystals on Tc in aluminum alloys containing silicon.

It is another object of this invention to provide a means for precisely determining the amount of silicon such an alloy.

It is another object of this invention to provide a means for ascertaining the degree of refining of such an alloy.

The inventors have now surprisingly discovered a crucible useful for the analysis of aluminum alloys which satisfies all of these objects of this invention, and other objects which will become apparent from a reading of the description given hereinbelow. This crucible is characterized in that the internal surface of at least one side wall of the crucible is covered, at least partially, with a film of refining agent. The whole internal surface of the crucible (all side walls plus bottom) can be covered with the refining agent. But the present invention only requries that, at minimum, the internal surface of a side wall be partially covered.

DETAILED DESCRIPTION OF THE PREFERRED EMBODIMENTS

The present inventors have sought to find a way of suppressing the influence of the size of the crystals on Tc so as to be able precisely to determine the amount of silicon and at the same time to ascertain the degree of refining of the alloy being analysed. This research has led to the discovery on which the present invention is based.

The means for suppressing the influence of the size of silicon crystals on Tc so as to be able to precisely determine the amount of silicon in the alloy and at the same time ascertain the degree of refining the alloy being analysed comprises using a crucible of the same type as those described in the "Discussion of the Background" section above. This crucible can have any of different geometries, e.g., it can have the geometry of any standard crucible heretofore used in the analysis of the alloys and can be made of the same material. The crucible used in the present invention however is characterised in that at least the side wall thereof is covered, in its internal surface and at least partially, with a film of refining agent.

The present inventors have found that by using such a crucible, when the crucible is filled with the alloy to be analysed, perfect refining of the alloy can be achieved in such a manner that the influence of the size of the crystals is completely neutralized and the measured temperature Tc is dependent exclusively on the silicon content of the alloy in question.

It is sufficient for the refining film, when it completely covers the wall, to be of a thickness of between 0.1 and 0.01 mm. A smaller thickness is adequate to produce the refining effect, whereas a greater thickness is found to superfluous.

When the side wall internal surface is only partially covered, the thickness of the film should be greater so as to provide an amount of refining agent equivalent to that contained in the crucible when the whole side wall internal surface is covered. However, the effectiveness of that covering is of greater or lesser magnitude, depending on the refining agent used.

Although any refining agent known in this art can be used, it has been found that red phosphorus is the most suitable material to use in the refining film of the present invention. In particular it is particularly advantageous to use red phosphorus in the form of grains having sizes smaller than 100 μm. Such a refining agent which cannot be used industrially because of the ease with which it spontaneously ingnites and the poor working conditions that it creates, can easily be used without particular danger with a crucible because of the very small amounts used.

In order to make it possible to produce a regular film which adheres firmly to the wall of the crucible, it is preferable to mix the red phosphorus with a binder such as for example aluminum diphosphate in solution in water in an amount of from 400 to 600, preferably 500 grams, of aluminum diphosphate per liter of solution, and in a proportion such that the ratio of the weight of phosphorus to that of the binder is between 0.25 and 1. Such a mixture produces a semi-liquid substance with which it is possible to coat the wall of the crucible and produce an adequate coating after drying at between 100 and 150° C.

Therefore, with such a crucible, it is possible to ascertain the Tc resulting solely from the influence of the silicon content. From the Tc value it is possible to deduce the precise content of silicon in the alloy by comparison with Tc values given by a theoretical curve of Tc in °C. versus silicon content (% Si and other alloy elements if appropriate), for the same type of alloy. The deduced silicon content in the alloy can then be corrected if needed in the casting ladle by the addition of Al-Si mother alloy.

It should be noted that such a system is very quick and very simple. It advantageously replaces more sophisticated methods for quantitative determination of silicon, such as for example neutronic activation.

In addition, such a crucible also makes it possible to ascertain the degree of refining of an alloy bath prior to casting. In fact, for that purpose it is only necessary to take a sample from the bath, measure its Tc both in a conventional non-coated crucible and in a crucible according to the invention, and compare the values obtained. If the temperatures are the same, it can be said that the bath is perfectly refined and that casting can be carried out, being secure in the knowledge of having the best properties linked with the degree of fineness of the grain.

In contrast, if Tc1 in the conventional crucible is lower than Tc2 in the crucible according to the invention, it is then deduced that the refining of the bath is incorrect and it is then known that refining agent has to be added to the bath in an amount dependent on the temperature difference detected.

Other features of the invention will become apparent in the course of the following descriptions of exemplary embodiments which are given for illustration of the invention and are not intended to be limiting thereof.

EXAMPLE

A hypereutectic aluminum-silicon alloy having a composition containing, by weight, Si (17%) and Cu (4%) was sampled prior to casting in a 2 ton ladle and subjected to thermal analysis in a conventional crucible and in a crucible provided on the internal surface of its side wall with a continuous 0.05 mm thick film composed of 30 g of red phosphorus having a granulometry of between 20 and 90 μm for 70 g of a solution containing 500 g/l of $Al_2(HPO_4)_3$.

The following temperatures were found:

Tc1 = 607° C.

Tc2 = 640° C.

It is deduced therefrom, on the basis of Tc2, that the silicon content of the alloy was 17% by weight and it was deduced on the basis of the difference (Tc2) − (Tc1) that the refining effect was not perfect.

After 2.5 kg of cupro-phosphorus with 7% by weight of phosphorus had been added to the bath, the analysis operations were repeated, giving on the one hand a value T'c2 of 620° C. (which is therefore lower than Tc2), indicating therefor that the bath has been diluted by the refining agent, and on the other hand a new value T'c1 equal to T'c2, showing that refining of the bath was now perfect.

The invention finds application in the simultaneous measurement of the silicon content and the degree of refining of hypereutectic aluminum-silicon alloys.

Obviously, numerous modifications and variations of the present invention are possible in light of the above teachings. It is therefore to be understood that within the scope of the appendent claims, the invention may be practiced otherwise than as specifically described herein.

What is claimed as new and desired to be secured by Letters Patent of the United States is:

1. A crucible for the thermal analysis of an aluminum alloy comprising a bottom and at least one of its side walls is at least partially covered with a film of a red phosphorus refining agent.

2. The crucible of claim 1 wherein the film of refining agent covers the internal surface of the said side wall completely and is from 0.1 to 0.01 mm in thickness.

3. The crucible of claim 1 wherein the phosporus is in the form of a powder having a granulometry of less than 100 μm.

4. The crucible of claim 1 wherein the red phosphorus is bonded to the wall by means of a solution of aluminum diphosphate containing from 400 to 600 g/l of aluminum diphosphate.

5. The crucible of claim 4 wherein the ration of the weight of phosphorus to that of the binder is between 0.25 and 1.

* * * * *